US009534769B1

(12) United States Patent
Liu et al.

(10) Patent No.: US 9,534,769 B1
(45) Date of Patent: Jan. 3, 2017

(54) LAMP HOLDER FOR LED LAMP STRING

(71) Applicants: Yao Wu Liu, Dongguan (CN); Kuo Chih Chen, Dongguan (CN)

(72) Inventors: Yao Wu Liu, Dongguan (CN); Kuo Chih Chen, Dongguan (CN)

( * ) Notice: Subject to any disclaimer, the term of this patent is extended or adjusted under 35 U.S.C. 154(b) by 13 days.

(21) Appl. No.: 14/790,221

(22) Filed: Jul. 2, 2015

(51) Int. Cl.
*H01R 33/00* (2006.01)
*F21V 21/00* (2006.01)
*F21Y 101/02* (2006.01)

(52) U.S. Cl.
CPC ..... *F21V 21/00* (2013.01); *F21S 4/10* (2016.01); *F21Y 2101/02* (2013.01)

(58) Field of Classification Search
CPC ..... F21V 19/0025; F21V 19/0015; F21S 4/10
USPC ..... 362/654
See application file for complete search history.

(56) References Cited

U.S. PATENT DOCUMENTS

2009/0010000 A1* 1/2009 Huang ..... F21V 19/0005 362/249.01

* cited by examiner

*Primary Examiner* — Jason Moon Han
*Assistant Examiner* — Keith Delahoussaye
(74) *Attorney, Agent, or Firm* — Ming Chow; Sinorica, LLC

(57) ABSTRACT

A lamp holder for an LED lamp string includes a base and an LED luminaire. The LED luminaire is inserted into the base. The base includes a casing, a cover, and a tail plug which are axially symmetric structures. The combination of the casing, cover and tail plug form a pin insertion hole of the LED luminaire and a wire inserting hole of a connecting wire of the lamp string, and the three are combined as a whole by a latch member, a latch slot, and a latch member. The cover and the tail plug seal an electrically conductive portion of the LED luminaire to provide a waterproof and dustproof effect. Since the casing, cover and tail plug are bilaterally symmetric structures, the level of difficulty of the alignment is reduced significantly. Automated equipment may be used for assembling the base in mass production, and the labor is reduced significantly.

1 Claim, 5 Drawing Sheets

LAMP HOLDER FOR LED LAMP STRING

FIELD OF THE INVENTION

The present invention relates to the field of LED illumination, in particular to a lamp holder for an LED lamp string that is applicable for automated mass production.

BACKGROUND OF THE INVENTION

LED lamp string is used extensively in the field of lighting such as municipal lighting, construction lighting, event lighting, retail lighting and landscape lighting, and its wide range of applications covers a large number of users. In general, an LED lamp string has tens or hundreds of LED lamp holders. In actual applications, many LED lamp string are used at the same time, so that consumption of the lamp holders is huge.

The present LED holder of an LED lamp string usually includes a base, an LED luminaire, a lamp cover, and a pin of the LED luminaire plugged into the base and contacted with a contact plate under the base to achieve the effect of electrical conduction, and the base is configured to be corresponsive to the lamp cover to protect and seals the LED luminaire. If the LED luminaire is damaged and requires replacement or an LED luminaire with a different light color is required for actual use, a user simply needs to remove the lamp cover and unplug the LED luminaire for a quick and convenient replacement of the LED luminaire.

In the actual production process of the LED lamp holder, it is necessary to align the LED luminaire with the insertion direction due to the limitation of the structure of the base in the LED lamp holder and it is a hindrance for automated mass production since the LED lamp holder must be assembled manually. However, the manual assembling process may cause errors such as making a wrong assembly or missing an assembly. Obviously, the manual processes cannot guarantee the yield rate of the product.

SUMMARY OF THE INVENTION

Therefore, it is a primary objective of the present invention to provide a lamp holder for an LED lamp string that is applicable for automated mass production.

To achieve the aforementioned objective, the present invention provides a lamp holder for an LED lamp string, comprising a base and an LED luminaire, characterized in that the LED luminaire is plugged into the base; the base includes a casing, a cover, and a tail plug which are axially symmetric structures; an outer wall of the casing includes a latch member, and a latch slot formed on the latch member; the casing has a first channel and a second channel formed along the axial direction of the casing and arranged coaxially in the same direction and connected with each other; the cover is inserted into the first channel and the cover has a shape corresponsive to the shape of the first channel; an outer wall of the cover has a tab corresponsive to he latch member for connecting and fixing the cover with the casing; the cover has a socket formed thereon and partitioned into two pin insertion holes by a partition plate; the bottom of the cover has a transverse slot formed thereon; the tail plug is inserted into the second channel; the sidewall of the tail plug has at least one latch slot formed thereon, and the latch slot is aligned precisely with the latch member on the inner wall of the second channel; the sidewall of the tail plug further has a plurality of wire slots formed thereon, and the wire slot together with the wire slot on the inner wall of the second channel form a plurality of wire inserting holes; and an upper part of the tail plug has a protrusion for inserting into the transverse slot.

The combination of the casing, the cover and the tail plug of the base form a pin insertion hole of the LED luminaire and a wire inserting hole of a connecting wire of the lamp string, and the three are combined as a whole by a latch member, a latch slot, and a latch member. The cover and the tail plug seal an electrically conductive portion of the LED luminaire to provide a waterproof and dustproof effect. Since the casing, cover and tail plug are bilaterally symmetric structures, the level of difficulty of the alignment is reduced significantly. Automated equipment may be used for assembling the base in mass production, and the labor is reduced significantly.

DESCRIPTION OF THE PREFERRED EMBODIMENTS

The aforementioned and other objectives and advantages of the present invention will become clearer in light of the following detailed description of an illustrative embodiment of this invention described in connection with the drawings.

Figure 1:
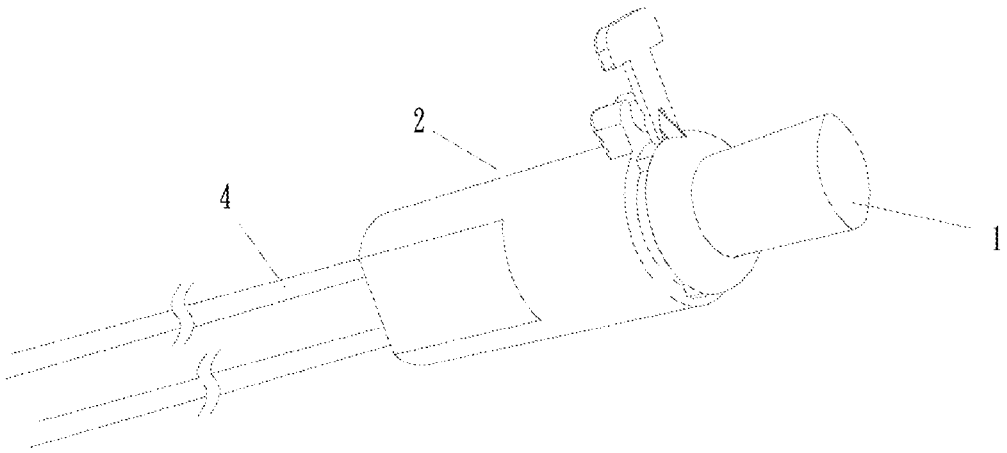
FIG. 1 is a schematic view of the present invention.
Figure 2:
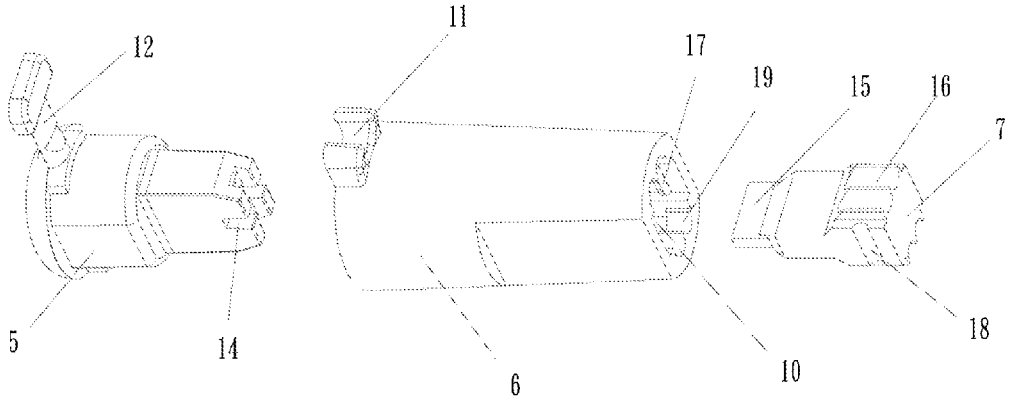
FIG. 2 is an exploded view of a base of the present invention.
Figure 3:
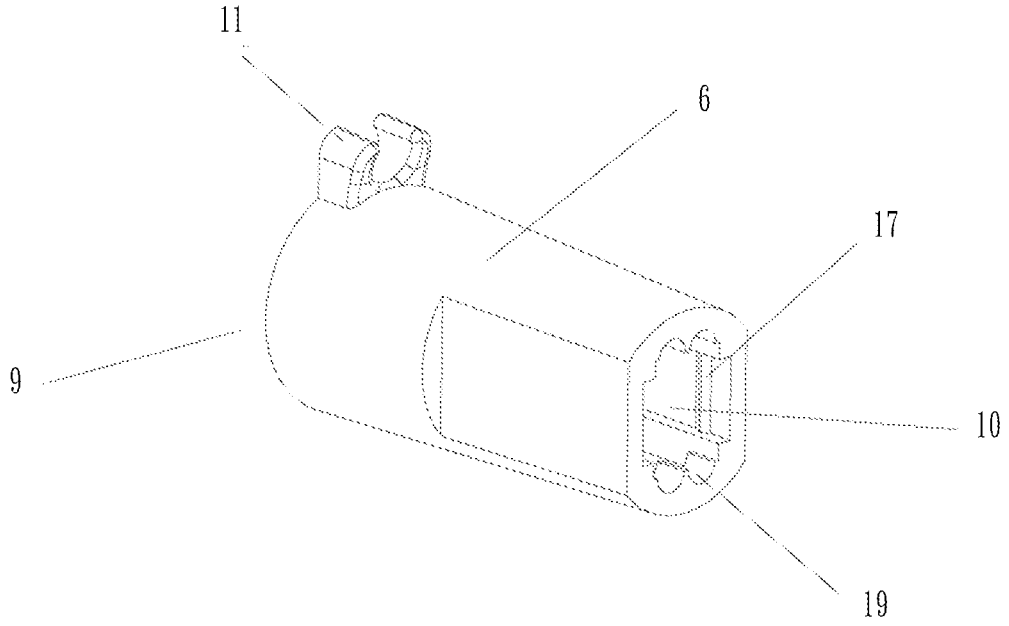
FIG. 3 is a schematic view of a casing of the present invention.
Figure 4:
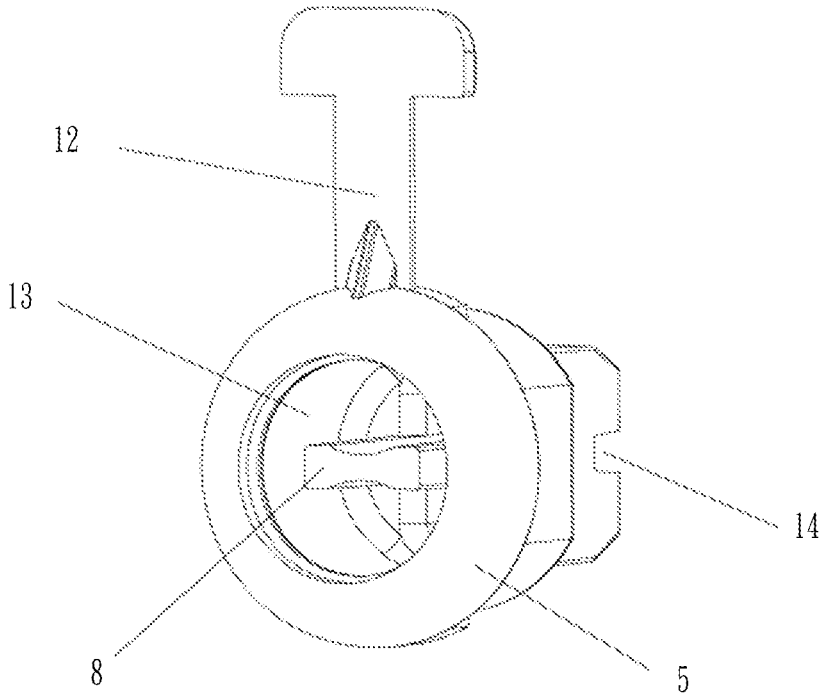
FIG. 4 is a schematic view of a cover of the present invention.
Figure 5:
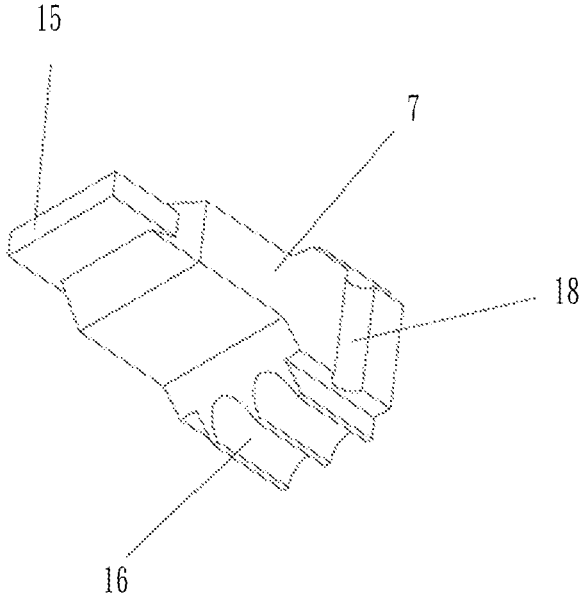
FIG. 5 is a schematic view of a tail plug of the present invention.

With reference to FIGS. 1 to 5 for a lamp holder for an LED lamp string of the present invention, the lamp holder comprises a base 2 and an LED luminaire 1, characterized in that the LED luminaire 1 is plugged into the base 2; the base 2 includes a casing 6, a cover 5, and a tail plug 7; the casing 6, the cover 5 and the tail plug 7 are axially symmetric structures; an outer wall of the casing 6 has a latch member 11, and the latch member 11 has a latch slot formed thereon; the casing 6 has a first channel 9 and a second channel 10 formed along the axial direction of the casing and arranged coaxially in the same direction and connected with each other; the cover 5 is inserted into the first channel 9, and the cover 5 has a shape corresponsive to the shape of the first channel; an outer wall of the cover 5 has a tab 12 corresponsive to he latch member 11 for connecting and fixing the cover 5 with the casing 6; the cover 5 has a socket 13 formed thereon and partitioned into two pin insertion holes by a partition plate 8; the bottom of the cover 5 has a transverse slot 14 formed thereon; the tail plug 7 is inserted into the second channel 10; the sidewall of the tail plug has at least one latch slot 18 formed thereon, and the latch slot 18 is aligned precisely with the latch member 17 on the inner wall of the second channel 10;

the sidewall of the tail plug further has a plurality of wire slots 16 formed thereon, and the wire slot 16 together with the wire slot 19 on the inner wall of the second channel 10 form a plurality of wire inserting holes, and the connecting wire 4 of the lamp string is inserted into the wire inserting hole; and an upper part of the tail plug 7 has a protrusion 15 for inserting into the transverse slot 14.

While the invention has been described by means of specific embodiments, numerous modifications and variations could be made thereto by those skilled in the art without departing from the scope and spirit of the invention set forth in the claims.

What is claimed is:

1. A lamp holder for a light-emitting diode (LED) lamp string, comprising a base and an LED luminaire, characterized in that the LED luminaire is plugged into the base; the base includes a casing, a cover, and a tail plug which are axially symmetric structures; an outer wall of the casing includes a latch member, and a latch slot formed on the latch member; the casing has a first channel and a second channel formed along the axial direction of the casing and arranged coaxially in the same direction and connected with each other; the cover is inserted into the first channel and the cover has a shape corresponsive to the shape of the first channel; an outer wall of the cover has a tab corresponsive to he latch member for connecting and fixing the cover with the casing; the cover has a socket formed thereon and partitioned into two pin insertion holes by a partition plate; the bottom of the cover has a transverse slot formed thereon; the tail plug is inserted into the second channel; the sidewall of the tail plug has at least one latch slot formed thereon, and the latch slot is aligned precisely with the latch member on the inner wall of the second channel; the sidewall of the tail plug further has a plurality of wire slots formed thereon, and the wire slot together with the wire slot on the inner wall of the second channel form a plurality of wire inserting holes; and an upper part of the tail plug has a protrusion for inserting into the transverse slot.

* * * * *